US005482339A

United States Patent [19]

Chishko, Jr.

[11] Patent Number: 5,482,339

[45] Date of Patent: Jan. 9, 1996

[54] ONE HANDED POUR HANDLE FOR PAINT CANS

[76] Inventor: Donald A. Chishko, Jr., 6 Robin Rd., Cardiff, N.J. 08232

[21] Appl. No.: 303,319

[22] Filed: Sep. 9, 1994

[51] Int. Cl.[6] ..... B65D 25/28

[52] U.S. Cl. ..... 294/27.1; 294/32; 220/759; 220/764

[58] Field of Search ..... 294/27.1, 28, 29, 294/30, 31.1, 31.2, 32; 248/210, 311.2, 312.1; 220/696, 736, 756, 759, 762, 764; 222/465.1, 567

[56] References Cited

U.S. PATENT DOCUMENTS

| | | | |
|---|---|---|---|
| 932,306 | 8/1909 | Miller | 294/27.1 X |
| 2,564,043 | 8/1951 | Ward | 220/762 X |
| 2,912,204 | 11/1959 | Raysinger | 248/210 |
| 4,053,131 | 10/1977 | Francis | 248/210 X |
| 4,602,723 | 7/1986 | DeMars | 294/27.1 X |
| 4,993,767 | 2/1991 | Song | 220/736 X |

*Primary Examiner*—Dean Kramer

[57] ABSTRACT

A one handed pour handle for paint cans comprising, in combination: a handle formed of a rigid plastic material having a central vertically oriented section for being grasped by the user; a lower vertically oriented section having a flat lower edge and outboard edge formed as a continuation of the outboard edge of the central section and having a forwardly extending lower portion with a notch extending downwardly from the upper edge for the receipt of the lower rim of a paint can to be held; and an upper vertically oriented section with a inboardly extending projection formed as a continuation of the outboard edge of the central section and positionable in contact with the upper portion of the hand of a user between the thumb and index finger, the upper edge being provided with a plurality of downwardly extending notches with outboardly angled continuations, one of which is adapted to receive the handle of a paint can as a function of the degree of tipping required to allow proper pouring of paint therefrom, the outboard edge of the upper portion, the upper section extending inboardly and being formed with an inboardly directed recess for the receipt of a supplemental support.

2 Claims, 4 Drawing Sheets

ONE HANDED POUR HANDLE FOR PAINT CANS

BACKGROUND OF THE INVENTION

1. Field of the Invention

The present invention relates to a one handed pour handle for paint cans and more particularly pertains to pouring paint from a can in an easy manner with a handle for single handed pouring.

2. Description of the Prior Art

The use of handles for assisting in the pouring of liquids for various containers is known in the prior art. More specifically, handles for assisting in the pouring of liquids for various containers heretofore devised and utilized for the purpose of assisting users in the pouring of contents from containers of various designs are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,993,767 to Song a detachable handle for containers.

U.S. Pat. No. 4,872,583 to Zelenka discloses a handle structure for paint container.

U.S. Pat. No. 4,823,433 to Curtis discloses a paint bucket handle accessory.

U.S. Pat. No. 4,702,395 to Nitsch discloses a paint can handle and spout attachment.

U.S. Pat. No. Des.276,586 to Hanna the design of a detachable handle for paint cans or the like.

In this respect, the one handed pour handle for paint cans according to the present invention substantially departs from the conventional concepts and designs of the prior art, and in doing so provides an apparatus primarily developed for the purpose of pouring paint from a can in an easy manner with a handle for single handed pouring.

Therefore, it Can be appreciated that there exists a continuing need for a few and improved one handed pour handle for paint cans which can be used for pouring paint from a can in an easy manner with a handle for single handed pouring. In this regard, the present invention substantially fulfills this need.

SUMMARY OF THE INVENTION

In view of the foregoing disadvantages inherent in the known types of handles for assisting in the pouring of liquids for various containers now present in the prior art, the present invention provides an improved one handed pour handle for paint cans. As such, the general purpose of the present invention, which will be described subsequently in greater detail, is to provide a new and improved one handed pour handle for paint cans and method which has all the advantages of the prior art and none of the disadvantages.

To attain this, the present invention essentially comprises a one handed pour handle for paint cans comprising, in combination: a handle formed of a rigid plastic material having a central vertically oriented section for being grasped by the user; a lower vertically oriented section having a flat lower edge and outboard edge formed as a continuation of the outboard edge of the central section and having a forwardly extending lower portion with a notch extending downwardly from the upper edge for the receipt of the lower rim of a paint can to be held; an upper vertically oriented section with a inboardly extending projection formed as a continuation of the outboard edge of the central section and positionable in contact with the upper portion of the hand of a user between the thumb and index finger, the upper edge being provided with a plurality of downwardly extending notches with outboardly angled continuations, one of which is adapted to receive the handle of a paint can as a function of the degree of tipping required to allow proper pouring of paint therefrom, the outboard edge of the upper portion, the upper section extending inboardly and being formed with an inboardly directed recess for the receipt of a supplemental support; and a supplemental support having an inboard recess adapted to receive the recess of the upper section, the sides of the supplemental support extending outboardly in a flared manner with a curved outboard edge having a radius of curvature substantially equal to that of the paint can to be held for providing a bearing surface during the tilting of the can for the pouring of its contents.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved one handed pour handle for paint cans which have all the advantages of the prior art handles for assisting in the pouring of liquids for various containers and none of the disadvantages.

It is another object of the present invention to provide new and improved one handed pour handle for paint cans which may be easily and efficiently manufactured and marketed.

It is further object of the present invention to provide new and improved one handed pour handle for paint cans which are of durable and reliable constructions.

An even further object of the present invention is to provide new and improved one handed pour handle for paint cans which are susceptible of a low cost of manufacture with regard to both materials and labor, and which accordingly are then susceptible of low prices of sale to the consuming public, thereby making such one handed pour handle for paint cans economically available to the buying public.

Still yet another object of the present invention is to provide a new and improved one handed pour handle for paint cans which provide in the apparatuses and methods of the prior art some of the advantages thereof, while simultaneously overcoming some of the disadvantages normally associated therewith.

Still another object of the present invention is to pour paint from a can in an easy manner with a handle for single handed pouring.

Lastly, it is an object of the present invention to provide new and improved one handed pour handle for paint cans comprising, in combination:a handle formed of a rigid plastic material having a central vertically oriented section for being grasped by the user; a lower vertically oriented section having a flat lower edge and outboard edge formed as a continuation of the outboard edge of the central section and having a forwardly extending lower portion with a notch extending downwardly from the upper edge for the receipt of the lower rim of a paint can to be held; and an upper vertically oriented section with a inboardly extending projection formed as a continuation of the outboard edge of the central section and positionable in contact with the upper portion of the hand of a user between the thumb and index finger, the upper edge being provided with a plurality of downwardly extending notches with outboardly angled continuations, one of which is adapted to receive the handle of a paint can as a function of the degree of tipping required to allow proper pouring of paint therefrom, the outboard edge of the upper portion, the upper section extending inboardly and being formed with an inboardly directed recess for the receipt of a supplemental support.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
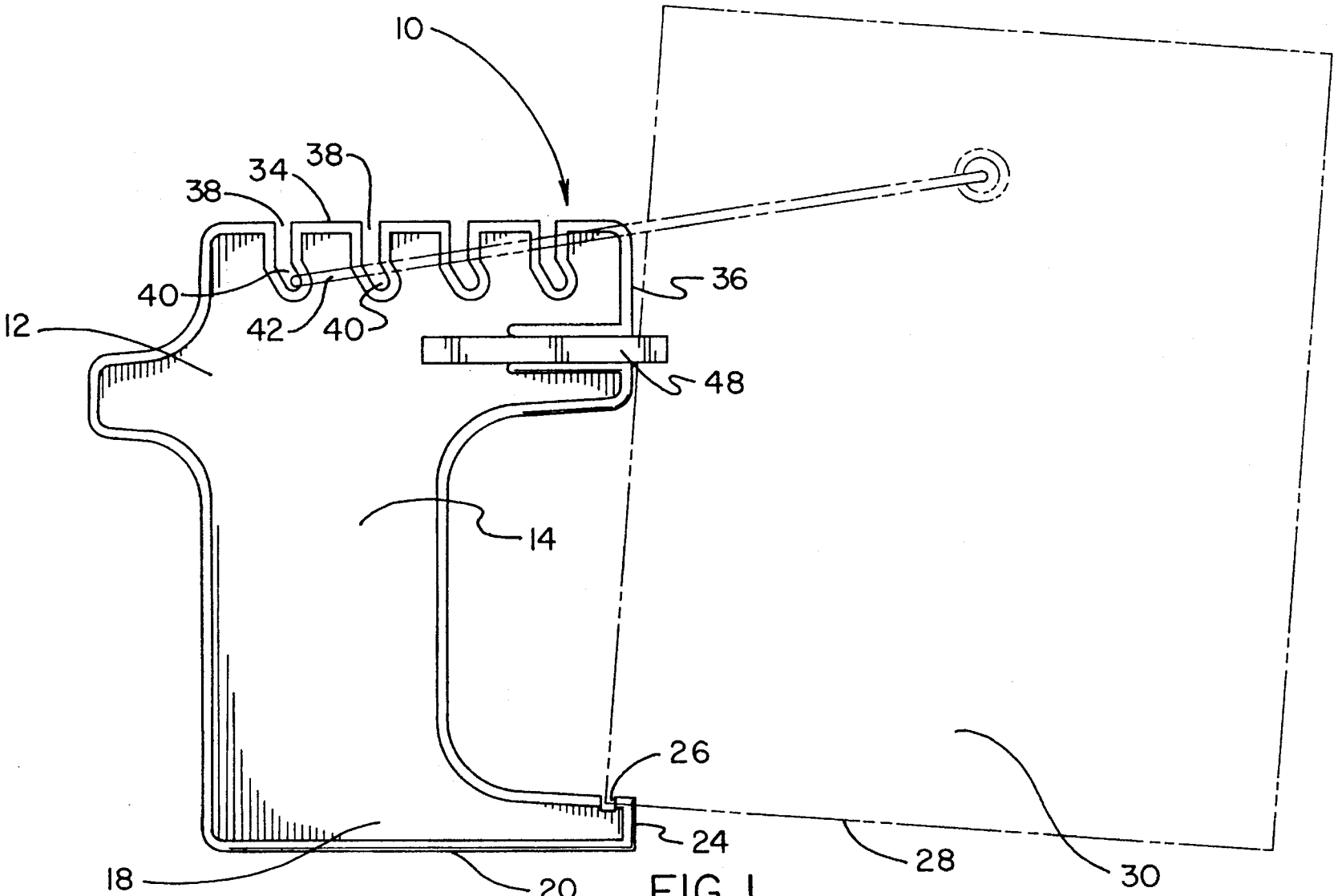
FIG. 1 is a side elevational view the new and improved one handed pour handle for paint cans constructed in accordance with the principles of the present invention.
Figure 2:
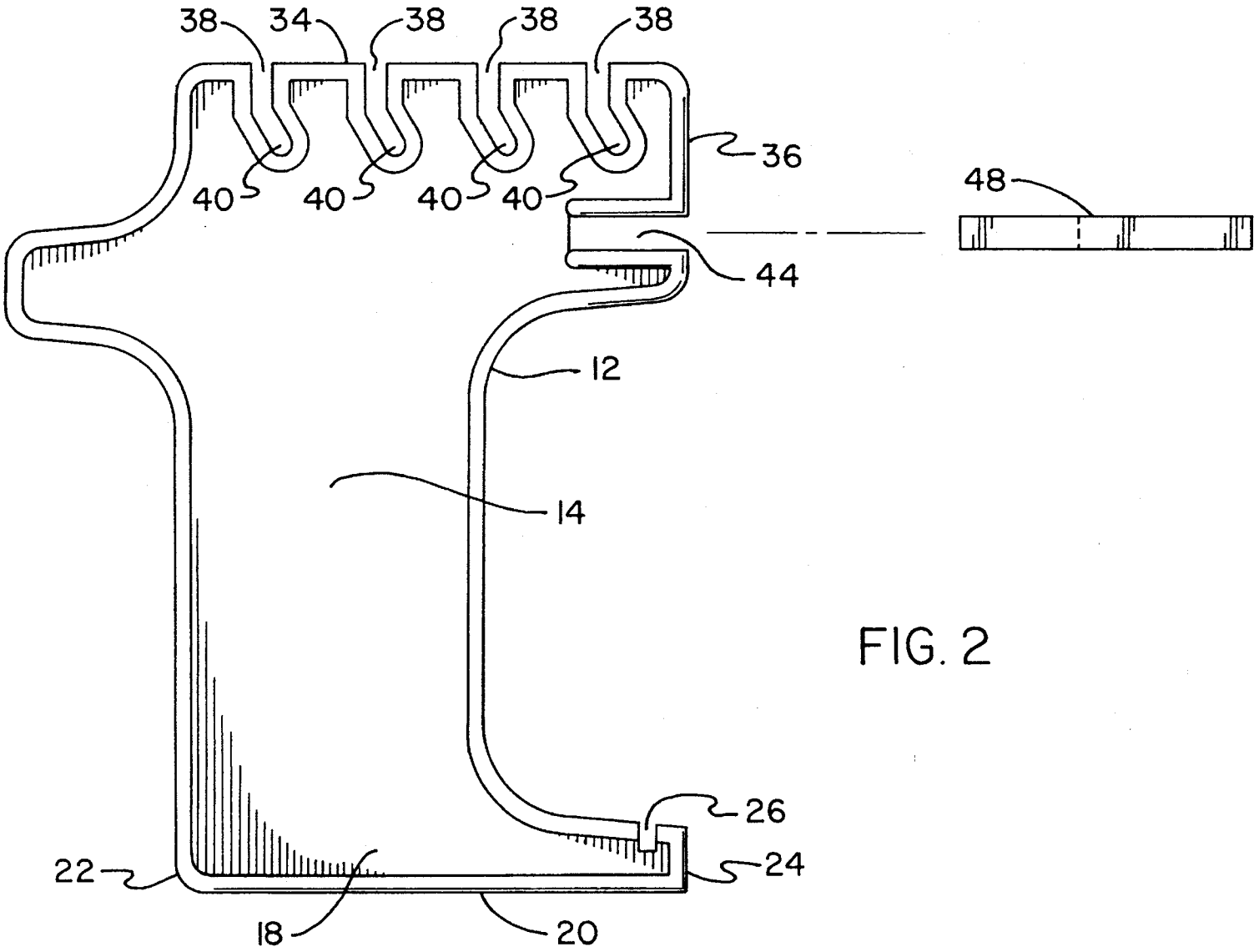
FIG. 2 is a side elevational view of the handle but with the spacer bar removed.

With reference now to the drawings, and in particular to FIG. 1 thereof, the preferred embodiment of the new and improved one handed pour handle for paint cans embodying the principles and concepts of the present invention and generally designated by the reference numeral 10 will be described.

The invention, the new and improved one handed pour handle for paint cans is comprised of a plurality of components. In their broadest context, such components include a handle, the handle having a central section, a lower section and an upper section and a supplemental support coupleable with the handle. Such components are specifically configured and correlated with respect to each other so as to attain the desired objective.

The main component of the system 10 is a handle 12. The handle is formed of a rigid material, preferably plastic. It has a central vertically oriented section 14. Such is for being grasped by the hand of a user.

In association with the central section is a lower vertically oriented section 18. Such lower section has a flat lower edge 20 and an outboard edge 22 formed as a continuation of the outboard edge of the central section. The lower section also has a forwardly extending lower portion 24 with a notch 26 extending downwardly from the upper edge. Such notch is for the receipt of the lower rim 28 of a paint can 30 to be supported by the handle.

The handle also has a vertically oriented upper section 34. Such upper section has an inboardly extending projection 36 formed as a continuation of the outboard edge of the central section. The upper section is received to be positioned in contact with the upper portion of a hand of a user between his or her thumb and index finger. The upper edge of the upper section is provided with a plurality of downwardly extending notches 38. Each notch has an outboardly angled continuation 40. A preselected one of the notches and continuations is adapted to receive the wire like handle 42 of a paint can to be tipped. The selected notch and continuation is a function of the degree of tipping required to allow proper pouring of paint from the can. The outboard edge of the upper section extends inboardly and is formed with an inboardly directed recess 44. Such recess is for the receipt of a supplemental support.

Figure 3:
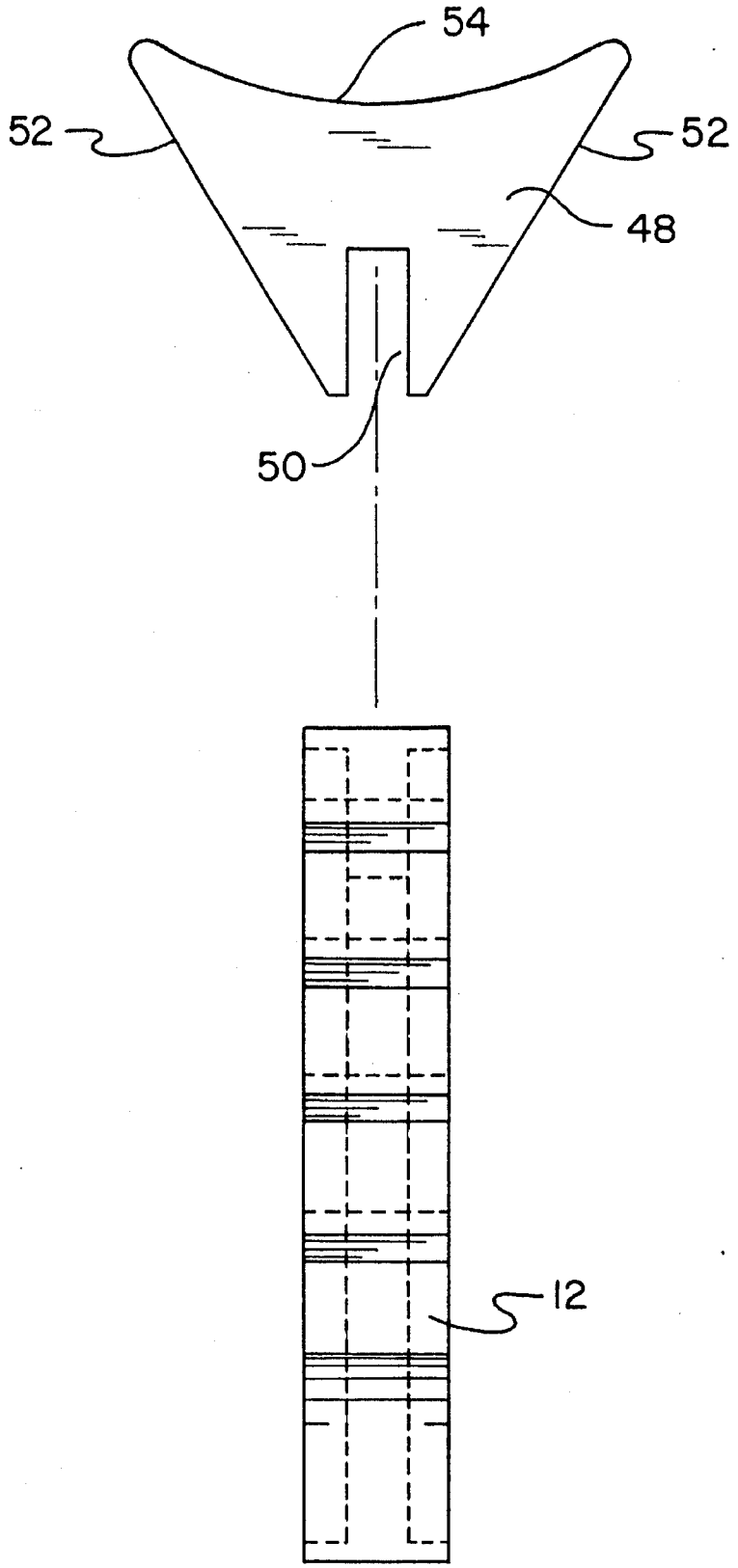
FIG. 3 is a top elevational view of the device shown in FIG. 2.
Figure 4:
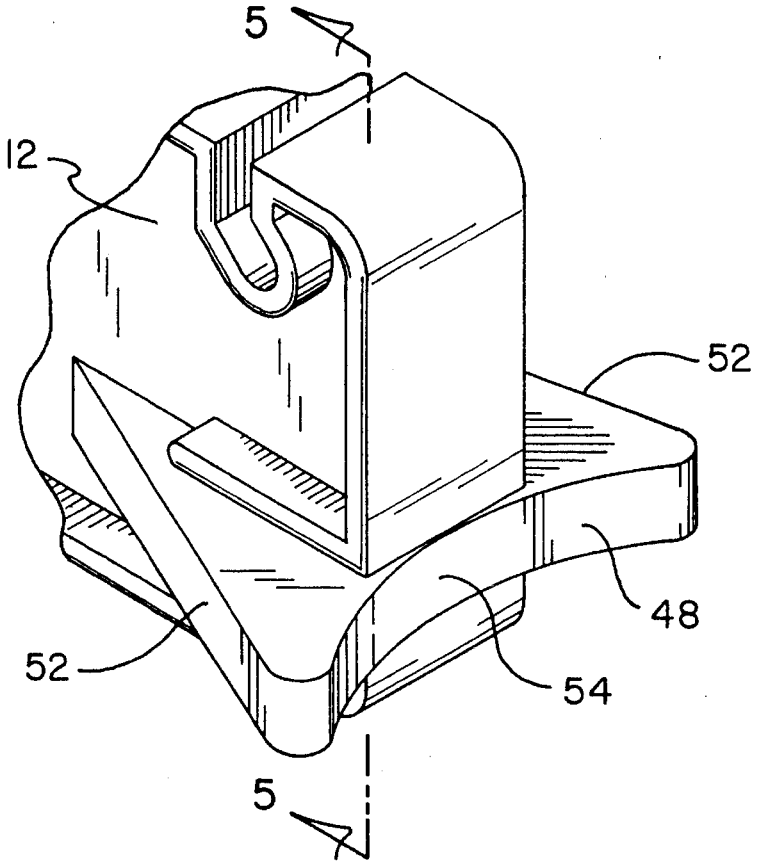
FIG. 4 is an enlarged perspective illustration of the front of the device shown in the prior figures illustrating the handle and spacer bar in a coupled orientation.
Figure 5:
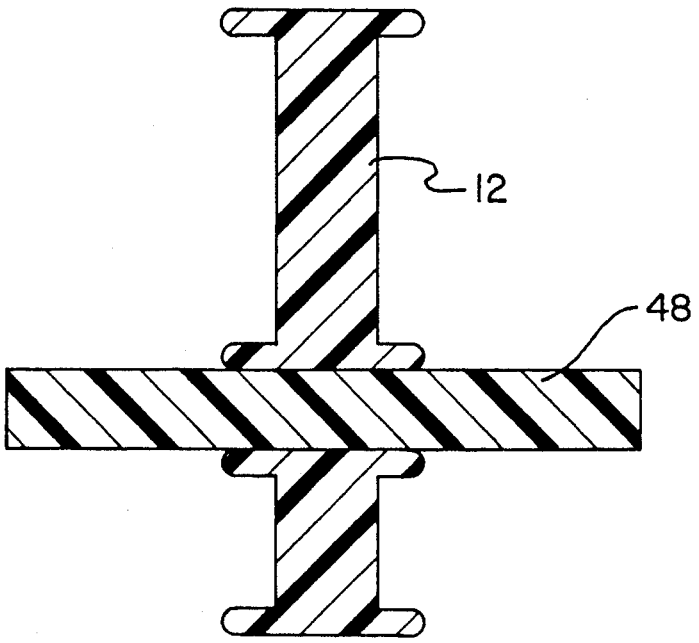
FIG. 5 is a cross sectional view of the device taken along line 5—5 of FIG. 4.

The only other component of the system 10 is the supplemental support 48. The supplemental support has an inboard recess 50. Such recess is adapted to be received in the recess of the upper section. The sides 52 of the supplemental support extend outboardly in a flared manner. Note FIGS. 3 and 4. The supplemental support also has a curved outboard edge 54. Such edge has a radius of curvature substantially equal to that of the paint can to be held. This is to provide for a bearing surface during the tilting of a can for the pouring of its liquid contents.

The present invention provides a convenient way to pour paint from a paint can, using only one hand. It therefore frees up the user's other hand to hold on to a paint brush or the like. This is a major step forward in convenience. Normally, it takes two hands to pour paint from a paint can. If you are in the middle of painting, that means putting down your brush or roller, which is always inconvenient, perhaps wiping off your painting hand, and then pouring more paint. Needless to say, this slows a person down considerably. The present invention offers a solution to this problem.

The present invention consist of a molded plastic handle that snaps on quickly and easily to a paint can. The handle is roughly two-thirds the height of the can. The bottom and top both extend out further than the middle. There is a notch in the top edge of the bottom extension in which the bottom rim of the pain can rests. The top of the handle has a series of four angled slots into which the handle of the can is hooked. There are four slots, to enable the user to adjust the handle as needed, depending on how much paint is left in the can. Hooking the can's handle in the slot closest to the can enables the can to lean at more of an angle, making it easier to pour paint from a near empty can. Using the slot furthest from the can, on the other hand, stands the can up straighter, which is better for pouring from a full can.

A small plastic attachment slides into the main part of the handle and provides a rounded edge that cradles the can and helps prevent it from shifting from side to side.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved one handed pour handle for paint cans comprising, in combination:

a handle formed of a rigid plastic material having a central vertically oriented section for being grasped by the user;

a lower vertically oriented section having a flat lower edge and outboard edge formed as a continuation of the outboard edge of the central section and having a forwardly extending lower portion with a notch extending downwardly from the upper edge for the receipt of the lower rim of a paint can to be held;

an upper vertically oriented section with a inboardly extending projection formed as a continuation of the outboard edge of the central section and positionable in contact with the upper portion of the hand of a user between the thumb and index finger, the upper edge being provided with a plurality of downwardly extending notches with outboardly angled continuations, one of which is adapted to receive the handle of a paint can as a function of the degree of tipping required to allow proper pouring of paint therefrom, the upper section extending inboardly and being formed with an inboardly directed recess for the receipt of a supplemental support; and a supplemental support having an inboard recess adapted to receive the recess of the upper section, the sides of the supplemental support extending outboardly in a flared manner with a curved outboard edge having a radius of curvature substantially equal to that of the paint can to be held for providing a bearing surface during the tilting of the can for the pouring of its contents.

2. A one handed pour handle for paint cans comprising, in combination:

a handle formed of a rigid plastic material in a generally planar configuration having a central vertically oriented section for being grasped by the user;

a lower vertically oriented section having a flat lower edge and outboard edge formed as a continuation of the outboard edge of the central section and having a forwardly extending lower portion with a notch extending downwardly from the upper edge for the receipt of the lower rim of a paint can to be held;

an upper vertically oriented section with an inboardly extending projection formed as a continuation of the outboard edge of the central section and positionable in contact with the upper portion of the hand of a user between the thumb and index finger, the upper edge being provided with a plurality of downwardly extending notches with outboardly angled continuations, one of which is adapted to receive the handle of a paint can as a function of the degree of tipping required to allow proper pouring of paint therefrom, the upper section extending inboardly and being formed with an inboardly directed recess for the receipt of a supplemental support; and a supplemental support having an inboard recess adapted to receive the recess of the upper section, the sides of the supplemental support extending outboardly in a flared manner with a curved outboard edge having a radius of curvature substantially equal to that of the paint can to be held.

* * * * *